United States Patent [19]

Solomon

[11] 4,163,560

[45] Aug. 7, 1979

[54] BOARD GAME

[76] Inventor: Arieh Solomon, 5, Anderson St., Ramat-Aviv, Tel-Aviv, Israel

[21] Appl. No.: 846,498

[22] Filed: Oct. 27, 1977

[30] Foreign Application Priority Data

Nov. 25, 1976 [IL] Israel ..... 50993

[51] Int. Cl.[2] ..... A63F 3/00

[52] U.S. Cl. ..... 273/273; 35/22 A; 35/73; 273/282; 273/288

[58] Field of Search ..... 273/269, 271, 273, 146, 273/288, 282; 35/22 A, 73

[56] References Cited

U.S. PATENT DOCUMENTS

| | | | |
|---|---|---|---|
| 1,760,642 | 5/1930 | Graham | 273/271 |
| 2,244,921 | 6/1941 | Roth | 273/273 |
| 2,542,948 | 2/1951 | Scherf | 273/153 X |
| 3,583,706 | 6/1971 | Glass et al. | 273/273 |
| 3,650,534 | 3/1972 | Collett | 273/253 X |

*Primary Examiner*—Anton O. Oechsle

*Attorney, Agent, or Firm*—Browdy and Neimark

[57] ABSTRACT

A board game comprising playing pieces each consisting of a body having a plurality of distinct orthogonal projection shapes and a board having sets of recesses, each set consisting of at least one recess of a shape corresponding to one of said projection shapes so that any playing piece has a like plurality of unique orientations, in each of which, it can be inserted into and retained by any recess of a particular set, and at least one die whose faces respectively display the shapes.

3 Claims, 12 Drawing Figures

Figures 1, 2, 3, 4, 5, 6, 7, 8, 9, 10, 11, 12:
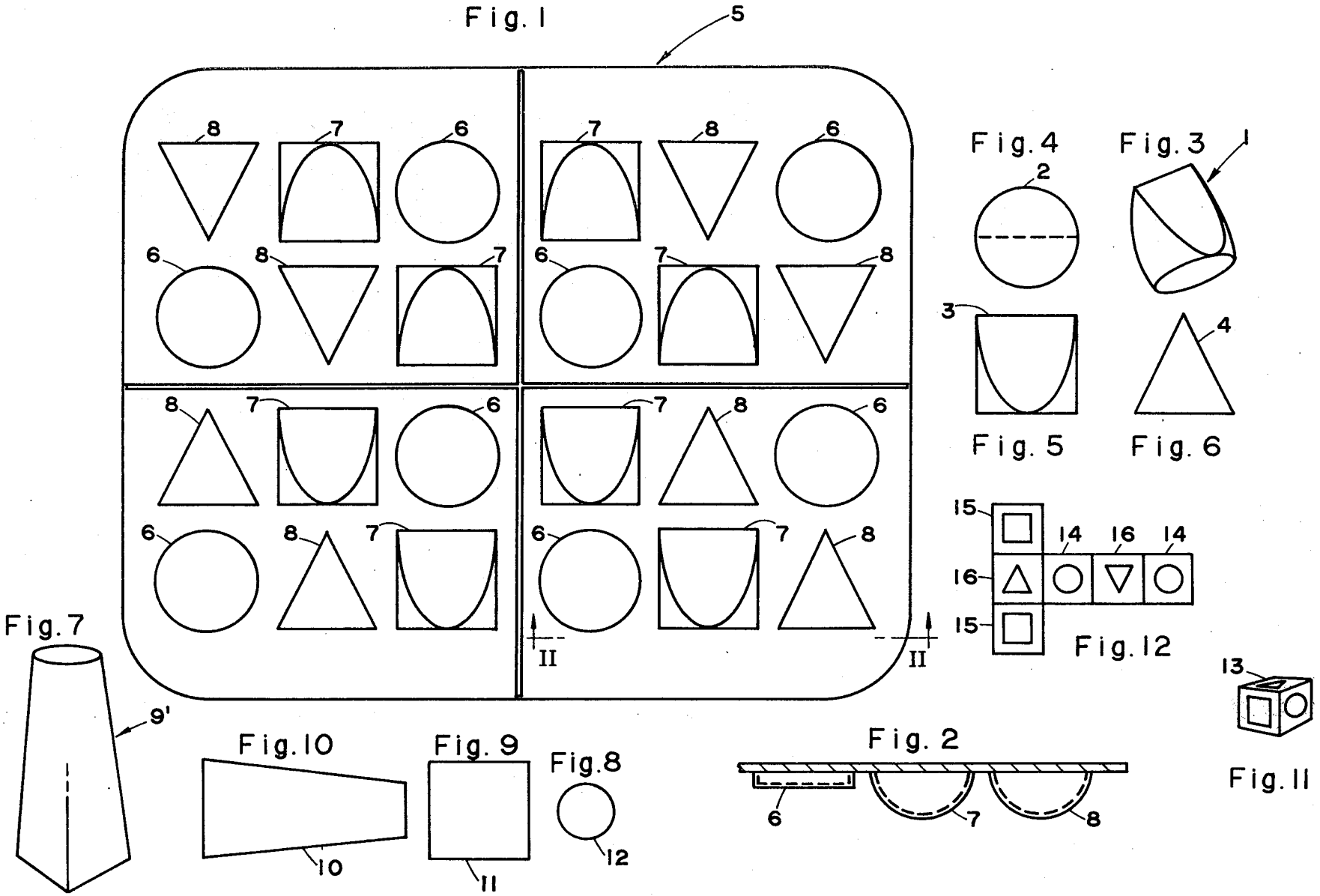

II
II

BOARD GAME

This invention relates to a board game which includes playing pieces each of which consists of a body having a plurality of distinct orthogonal projection shapes. Thus, by varying the orientation of the playing piece in space a differing projection shape is displayed when the body is viewed orthogonally.

Such a playing piece will hereinafter be referred to as a playing piece of the kind specified.

According to the present invention there is provided a board game comprising playing pieces of the kind specified, a board having sets of recesses, each set consisting of one or more recesses of shapes corresponding to one of said projection shapes so that any playing piece has a like plurality of unique orientations, in each of which, it can be inserted into and retained by any recess of a particular set, and at least one die whose faces respectively display said shapes.

Such a board game is specially designed for play by young children (for example, of the 3 to 5 year old age group). For such an age group and quite apart from the competitive aspect of the game, to be described below, considerable educational value resides in the child learning to appreciate that the playing piece, in his hand, can be orientated so as to display differing projection shapes. The child learns to appreciate this fact when manipulating the playing piece, initially on a trial and error basis, so as to fit it into an appropriate recess. Eventually the child learns to associate the shape of the recess with a particular projection shape of the playing piece and therefore learns to orientate the piece so that this projection shape is orthogonally disposed with respect to the recess whereupon the playing piece can be directly fitted into and retained by the appropriate recess.

By preliminary throwing the die and observing which shape is displayed on the uppermost face thereof, the child has the following dual task: (a) he must identify a recess of a shape corresponding to the shape displayed by the die, (b) he must orientate the playing piece so that the same projection shape is orthogonally disposed with respect to the recess, and (c) he must insert the playing piece orthogonally into the recess so that it is retained thereby.

Where, however, the game is to be played competitively between, for example, two players, each player is provided with the same number of playing pieces, which are preferably identical, and each player successively throws the die, picks up a piece, orientates it so that the projection shape thereof orthogonal to the board is identical with the shape represented by the die and inserts the piece in the corresponding vacant recess in the board. It will be appreciated that seeing that there are only a limited number of recesses associated with any particular shape, these recesses become progressively filled with playing pieces and, should the die thrown by a player display a shape corresponding to fully occupied recesses then the player misses a turn. The game is won by the player who disposes first of all his playing pieces or, alternatively, when all the recesses are filled is left with the minimum number of playing pieces.

For a better understanding of the present invention and to show how the same may be carried out in practice, reference will now be made to the accompanying drawings in which:

FIG. 1 is a plan view from above of a playing board for use in a board game in accordance with the invention, FIG. 2 is a cross-sectional view of a portion of the board shown in FIG. 1 taken along the line II—II, FIG. 3 is a perspective view of a first form of playing piece of the kind specified, FIGS. 4, 5 and 6 are respective differing orthogonal projection shapes of the playing piece shown in FIG. 3, FIG. 7 is a perspective view of a second form of playing piece of the kind specified, FIGS. 8, 9 and 10 are respective orthogonal projection shapes of the playing piece shown in FIG. 7, FIG. 11 is a perspective view of a die used in playing the board game in accordance with the present invention, and FIG. 12 is a developed view of the faces of the die shown in FIG. 11.

As can be seen in FIGS. 3, 4, 5 and 6 of the drawings a playing piece 1 is so shaped as to have three orthogonally directed projection surfaces, namely a circular surface as seen in FIG. 4, a rectangular square surface 3 as seen in FIG. 5 and a triangular surface 4 as seen in FIG. 6.

A playing board 5 as shown in FIGS. 1 and 2 of the drawings is formed with sets of recesses so shaped as to conform with the orthogonal shapes 2, 3 and 4. Thus, as can be seen in FIG. 1 of the drawings, each set comprises six recesses of the same shape, namely recesses 6 corresponding to the shape 2, recesses 7 corresponding to the shape 3 and recesses 8 corresponding to the shape 4. As can be clearly seen in FIG. 2 of the drawings the recesses are so dimensioned that, when the corresponding shape of the playing piece 1 is orthogonally introduced therein the recess accommodates and retains the piece.

An alternative form of playing piece 9 is shown in FIG. 7 of the drawings having orthogonally directed projection faces 10, 11 and 12.

A die 13 shown in FIG. 11 of the drawings is provided with face pairs 14, 15 and 16 displaying respectively the shapes 2, 3 and 4.

The game is played with two players each receiving an equal number of playing pieces 1. Upon throwing the die 13 a shape is displayed on the uppermost exposed surface of the die and the player must first ascertain whether a recess of corresponding shape is available to be filled. If no such recess is available then the player loses his turn. If, on the other hand a recess is available, then the player takes one of the playing pieces 1 and orientates it so that the appropriate projection shape is orthogonally disposed with respect to the recess to be filled whereupon the piece can be inserted into the recess and retained therein.

The game continues until one player, the winner, has disposed of all his pieces or, alternatively, until all the recesses have been filled whereupon the winner is the player with the least number of pieces.

It will be appreciated that a board having recesses corresponding to the shapes 10, 11 and 12 of the playing piece 9 can be readily designed.

It will be furthermore appreciated that, in addition to the intrinsic interest which a young child will have in playing the game as described above, identifying the projection shapes of the playing pieces and associating these shapes on the one hand with the representations on the die and on the other hand with the recesses, is of educational value. In this connection the child can use the game for his own amusement and benefit even when not playing with a fellow child.

Furthermore, whilst in the specific examples shown above each playing piece has had three distinct orthogonally directed projection shapes, playing pieces having other numbers of shapes can well be envisaged. Thus a playing piece having only two such shapes can be employed for use by the youngest of children whilst playing pieces having more than three such shapes can be used with older children.

I claim:

1. A board game comprising playing pieces each consisting of a body having a plurality of distinct orthogonal projection shapes and a board having sets of recesses, each set consisting of at least one recess of a shape corresponding to one of said projection shapes so that any playing piece has a like plurality of unique orientations, in each of which, it can be inserted into and retained by any recess of a particular set, and at least one die whose faces respectively display said shapes.

2. A board game according to claim 1 wherein each playing piece has three distinct orthogonally directed projection shapes.

3. An educational game comprising the steps of:

a. throwing a die bearing on its faces respective shapes;

b. identifying a recess from a plurality of recesses formed in a board having a shape corresponding to the shape displayed by the die;

c. orientating a playing piece having a plurality of distinct, orthogonal projection shapes so as to be orthogonally disposed with respect to the identified recess; and d. inserting the playing piece orthogonally into the recess so as to be retained thereby.

* * * * *